US010174984B2

(12) United States Patent
Vorosmarti, III et al.

(10) Patent No.: US 10,174,984 B2
(45) Date of Patent: Jan. 8, 2019

(54) ICE MAKING SYSTEM WITH PROVISION FOR CLEANING AND CLEANING METHOD

(71) Applicant: Follett Corporation, Easton, PA (US)

(72) Inventors: James Vorosmarti, III, Center Valley, PA (US); Mats Erninger, Harleysville, PA (US); Leroy Kramer, Brodheadsville, PA (US); Michael Purcell, Easton, PA (US); Stephen E. Rottloff, Quakertown, PA (US)

(73) Assignee: Follett Corporation, Easton, PA (US)

( * ) Notice: Subject to any disclaimer, the term of this patent is extended or adjusted under 35 U.S.C. 154(b) by 0 days.

(21) Appl. No.: 15/254,556

(22) Filed: Sep. 1, 2016

(65) Prior Publication Data

US 2018/0058743 A1 Mar. 1, 2018

(51) Int. Cl.
*F25C 5/182* (2018.01)

(52) U.S. Cl.
CPC ..... *F25C 5/182* (2013.01); *F25C 2400/12* (2013.01); *F25C 2600/04* (2013.01)

(58) Field of Classification Search
CPC .. F25C 2400/12; F25C 2600/04; F25C 5/182; F25C 5/18; F25C 1/00
USPC ..... 62/303
See application file for complete search history.

(56) References Cited

U.S. PATENT DOCUMENTS

| | | | | |
|---|---|---|---|---|
| 5,613,660 | A * | 3/1997 | Wyatt | A47F 13/08 248/300 |
| 7,469,548 | B2 | 12/2008 | Brunner et al. | |
| 8,627,675 | B2 * | 1/2014 | Kruckenberg | B23P 19/04 62/318 |
| 8,756,950 | B2 | 6/2014 | Brunner et al. | |
| 8,844,312 | B2 | 9/2014 | Yoshida et al. | |
| 9,056,337 | B2 | 6/2015 | Walker et al. | |
| 2012/0023998 | A1 * | 2/2012 | Oh | F25C 5/22 62/340 |
| 2012/0031135 | A1 * | 2/2012 | Schill | F25C 1/142 62/303 |
| 2013/0174875 | A1 * | 7/2013 | Walker | B08B 9/027 134/22.11 |
| 2014/0196493 | A1 * | 7/2014 | Mitchell | F25C 5/182 62/344 |

OTHER PUBLICATIONS

Scotsman Ice Systems, "Installation and User's Manual for Residential Nugget Ice Machine, Model SCN60," May 2011, pp. 1, 13-15.
Manitowoc, "SM Model Ice Machines, Installation, Use and Care Manual," May 2010, pp. 1, 15-20.
Hoshizaki America, Inc., "Self-Contained Cubelet, Models C-101BAH, C-101BAH-DS, C-101BAH-AD, C-101BAH-ADDS, Instruction Manual," Jul. 25, 2013, pp. 1, 32-34.

* cited by examiner

*Primary Examiner* — Ana Vazquez
(74) *Attorney, Agent, or Firm* — Paul & Paul

(57) ABSTRACT

An ice making apparatus includes an ice machine for making ice with internal surfaces that come in contact with water and ice during normal operation. A cleaning container provides receiving cleaning solution to clean and disinfect the internal surfaces of the ice machine. A programmable control system controls the cleaning operation.

14 Claims, 16 Drawing Sheets

ICE MAKING SYSTEM WITH PROVISION FOR CLEANING AND CLEANING METHOD

BACKGROUND OF THE INVENTION

1. Field of the Invention

The present invention relates to ice makers and the like having a built in provision for their cleaning and a cleaning method applicable to such devices.

2. Description of the Prior Art

Under-counter ice machines with storage bins have been used in the industry for many years. These are mostly cube ice making machines but there are also some machines that make ice nuggets from compressed ice.

Because of the small size of these machines and their intended location under a counter, they are hard to clean. Some machines require a funnel and hose to clean and some machines require disassembly of parts in the rear of the bin under the counter. Thus cleaning the machine is onerous and unlikely to occur. To keep the machine clean and sanitary it is required that the machines be cleaned to remove scale from hardness in the water and sanitized to kill any micro-organisms growing in the machine.

Small, under-counter ice machines currently available in the market have cleaning procedures that are inadequate because of several shortcomings. These shortcomings include the following:

1. The cleaning procedures are difficult to carry out;
2. The cleaning procedures cannot be performed in a reasonable amount of time;
3. The cleaning procedures cannot be performed without tools;
4. The cleaning procedures require personnel with special skills; and
5. The cleaning procedures expose the person performing the task to some potential hazards, for example, electric shock hazard, or chemical exposure.

The Scotsman SCN60 ice machine (See reference 1 for cleaning procedure) requires a special tool (a squirt bottle) that a customer may not have on hand to squirt cleaning and sanitizing solution into a reservoir in the rear of the machine. This is awkward as the user must remove parts of the machine to get access to the reservoir. It is also time-consuming as the process takes about 2 hours to perform. The customer may not get all the parts correctly reinstalled into the machine.

The Manitowoc SM series ice machines (see reference 2 for cleaning process) require a special tool (a container that will fit easily under the lifter water shutters, and a soft bristle nylon brush) that a customer may not have on hand. The process requires the removal of many parts which is awkward for a piece of equipment installed under a counter. It is also time-consuming as the process takes about 2 hours to perform. The customer may not get all the parts correctly reinstalled into the machine.

The Hoshizaki C-101BAH ice making apparatus (see reference 3 for cleaning procedure) requires a special tool (a funnel and hose) that a customer may not have on hand. This process requires the customer to hold the end of the hose above the ice auger which is a safety hazard and awkward). It is also time-consuming as the process takes about 2 hours to perform.

Ice making systems are discussed in U.S. Pat. Nos. 9,056,337, 8,844,312, 8,756,950, and 7,469,548, some of which address cleaning procedures, and all of which are incorporated by reference in their entirety herein.

However, none of the prior art ice making systems are seen to provide a cleaning procedure that is easy to carry out, can be performed in a reasonable amount of time, can be performed without tools, can be performed by someone without any special skills, and that does not subject the person performing the task to any danger.

SUMMARY OF THE INVENTION

The present invention is directed to an ice making system having provision for cleaning procedures that address the shortcomings, discussed above, of prior art systems. The cleaning system and procedure of the present invention meets the following requirements:

1. The procedure is easy to carry out; the process is a clean in place operation, and no parts need to be removed from the machine to perform the cleaning process;
2. The procedure can be performed in a reasonable amount of time; the process takes about half an hour;
3. The procedure can be performed without tools; no special tools are required;
4. The procedure can be performed by someone without any special skills; no special skills are required;
5. The system and procedure do not subject the person performing the cleaning to any danger; there are no hazards presented to personnel performing this procedure.

The design of the ice machine incorporates a cleaning drawer located above the ice discharge tube so that the entire ice making machine can be flooded with cleaner and sanitizer. The machine user or operator pours the cleaning and sanitizing solution into the drawer and the solution floods all of the parts and pieces of the ice maker that are exposed to water and ice. The drawer includes a tube connected on the rear that moves with the drawer as it is opened and closed. This tube fits inside a stationary tube with a telescoping joint sealed against liquid leakage with a seal, for example one or more rubber gaskets, one or more rubber O-rings, or a rubber boot, that permits sliding movement of the tube connected to the drawer relative to the stationary tube while sealing the joint against liquid leakage. It is also possible to arrange for the stationary tube to fit inside the tube connected to the drawer, but it is preferred for the tube connected to the drawer to fit inside the stationary tube.

In presently preferred embodiments, the procedure according to the present invention for cleaning and sanitizing the under-counter ice making system may employ some or all the following equipment in some embodiments:

1. (2) 1.5 Gallon (or larger) plastic puckets: one for cleaning solution, one for ice;
2. (2) Clean cloths;
3. Gloves;
4. Safety glasses;
5. (1) Packet of SafeCLEAN™ Plus (Part no. 01050863—case of 24 packets)

The cleaning solution can be made, for example, by adding one 7 ounce packet of Follett SafeCLEAN™ Plus ice machine cleaner to 1 gallon of hot (100° F.) water.

In presently preferred embodiments, the procedure according to the present invention for cleaning and sanitizing the under-counter ice making system may be as follows:

1. Press CLEAN switch. The CLEAN light will turn on and the machine will drain.
2. Wait for the CLEAN light to blink to indicate that the machine has drained.

3. Open cleaning drawer and pour cleaning solution into drawer until cleaning solution overflows from the ice transport tube into the hopper (about 2 quarts). Save remainder of cleaning solution.
4. Close cleaning drawer.
5. The CLEAN light will stop blinking and return to solid green. Machine will start cleaning cycle then rinse three times; this process takes approximately 15 minutes.
6. While the machine is automatically cleaning:
a. Remove ice from bin and discard.
b. Wipe the ice storage bin, scoop, and inside of door with a clean cloth wet with cleaning solution.
c. Rinse the ice storage bin, scoop, and inside of door with a clean cloth wet with fresh water.
7. When machine is finished automatically cleaning, the CLEAN light will turn off and the machine will start making ice.
8. After 10 minutes scoop out and discard first batch of ice produced.

The under-counter ice machine of the present invention incorporates improvements from earlier patents of the assignee of the present invention.

The under-counter ice machine of the present invention incorporates the shuttle from U.S. Pat. No. 7,469,548, which is incorporated by reference in its entirety herein. This shuts the ice machine off when the bin is full. Many current under counter ice machines use a thermostat to shut off the machine. These are mechanical switches, well-known in the industry, that are prone to failure. They change state from the pressure differential between a contained gas that pushes against a bellows, so they are subject to atmospheric pressure. At high altitudes the set-point can vary from that at sea level, leading to over-filling of the bin so that when the door is opened the ice spills onto the floor.

In the under-counter ice machine of the present invention, ice machine restart is based on ice usage. A thermostat controlled machine turns off when the thermostat gets cold (from a piece of ice on it) and turns on when it gets warm (the ice melts off or falls off). This can lead to many ice machine starts per day, even when no one takes ice from the bin. With the shuttle system, the ice machine turns off when the bin is full, but needs a method to turn it back on. In some current ice machines, a cumulative dispense time is used that is recorded by the control system and compared to a set value in the software. When enough ice has been dispensed, the ice machine restarts. This ties the ice making to periods of ice demand and prevents the machine from turning on multiple times overnight and on weekends when there is little demand.

On the ice bin of the present invention, there is no dispense means but we also need a method to turn the ice machine on. This bin uses the door opening as a signal of ice demand and turns the machine on if the door is open for a sufficient amount of time. This prevents the machine from turning on many times overnight or at other times such as winter or vacations when there is little demand for ice.

Sanitation in Public Places

When open scoop out bins are placed in public places, business offices, corporate lunchrooms, and the like, there is a sanitation risk, some people will not use the scoop to place ice into their cup, glass or sports bottle, but rather use their cup, glass or sports bottle as a scoop. This practice can introduce microorganisms from their drink container into the ice in the bin that could infect a later user of the bin.

In a presently preferred embodiment of the present invention, the scoop is provided in the center of the bin with the handle up. This discourages a user from easily scooping ice with a container that could possibly be contaminated. The invention in this embodiment provides a visual clue to a user that the scoop is to be used to retrieve ice from the bin.

It is an aspect of the present invention to provide an ice making system having a cleaning solution drawer.

In one presently preferred embodiment of the present invention, a shuttle actuator is used rather than a thermostat to stop the ice making operation.

In one presently preferred embodiment of the present invention, an ice making system is provided wherein the ice making operation is initiated in response to some aspect of the opening of the door of the ice making system, for example, door opening frequency, duration, or both.

In one presently preferred embodiment of the present invention, an ice making system is provided wherein the scoop for removing ice from the ice bin projects prominently, at least in part, into the ice bin opening.

In one presently preferred embodiment of the present invention, an ice making apparatus is provided, the ice making apparatus comprising:

an ice machine for making ice, the ice machine having internal surfaces that come in contact with water and ice during normal operation of the ice making and storage apparatus;

a cleaning container housed within the ice making and storage apparatus, the cleaning container being provided for receiving a quantity cleaning solution;

a cleaning container outlet conduit communicating with the cleaning container, the cleaning container outlet conduit allowing the cleaning solution to be conducted from the cleaning container to the ice machine to clean and disinfect the internal surfaces of the ice machine; and a programmable control system controlling the conduction of the cleaning solution to the ice machine in accordance with a cleaning program during a cleaning operation.

It is a further aspect of the present invention to provide an ice making apparatus wherein the programmable control system controls flow of the cleaning solution so as to flood the internal surfaces of the ice machine with the cleaning solution during the cleaning operation to thereby clean and disinfect the internal surfaces of the ice machine.

In a presently preferred embodiment of the present invention, an ice making apparatus is provided wherein the ice making apparatus further comprises a cabinet housing at least the ice machine, wherein the cleaning container is in the form of a drawer supported, preferably for rectilinear motion, by the cabinet between a first position within the cabinet and a second position, a user being able to access the cleaning container for filling with the cleaning solution at least when the cleaning container is in the second position, wherein the cleaning container outlet conduit has a first portion and a second portion, wherein the first portion of the cleaning container outlet conduit is fixed relative to the cleaning container, wherein the second portion of the cleaning container outlet conduit is fixed relative to the cabinet, wherein the first portion of the cleaning container outlet conduit is connected for fluid communication to the second portion of the cleaning container outlet conduit by a telescoping joint between the first portion of the cleaning container outlet conduit and the second portion of the cleaning container outlet conduit, and wherein the telescoping joint is sealed by at least one sealing element.

In a presently preferred embodiment of the present invention, an ice making apparatus is provided wherein the at least one sealing element is selected from a rubber gasket, a rubber O-ring, and a rubber boot.

In a presently preferred embodiment of the present invention, an ice making apparatus preferably further comprises:

an ice storage bin; and an ice discharge inlet communicating with the ice storage bin and the ice machine, the ice discharge inlet allowing the ice made by the ice machine to be discharged into the ice storage bin;

wherein the ice machine has an ice discharge outlet, the ice making and storage apparatus further comprising an ice transport conduit communicating with the ice discharge outlet and the ice discharge inlet to thereby allow the ice made by the ice machine to be transported to the ice storage bin, and wherein the ice transport conduit has internal surfaces that come in contact at least with ice during operation of the ice making apparatus.

In a presently preferred embodiment of the present invention, an ice making apparatus is provided wherein the programmable control system controls flow of the cleaning solution so as to flood the internal surfaces of the ice machine and the internal surfaces of the ice transport conduit with the cleaning solution during the cleaning operation to thereby clean and disinfect the internal surfaces of the ice machine and the internal surfaces of the ice transport conduit.

In a presently preferred embodiment of the present invention, an ice making apparatus is provided wherein the ice making apparatus further comprises a cabinet housing at least the ice machine and the ice storage bin, wherein the cleaning container is in the form of a drawer, preferably supported for rectilinear motion by the cabinet, between a first position within the cabinet and a second position, a user being able to access the cleaning container for filling with the cleaning solution at least when the cleaning container is in the second position, wherein the cleaning container outlet conduit has a first portion and a second portion, wherein the first portion of the cleaning container outlet conduit is fixed relative to the cleaning container, wherein the second portion of the cleaning container outlet conduit is fixed relative to the cabinet, wherein the first portion of the cleaning container outlet conduit is connected for fluid communication to the second portion of the cleaning container outlet conduit by a telescoping joint between the first portion of the cleaning container outlet conduit and the second portion of the cleaning container outlet conduit, and wherein the telescoping joint is sealed by at least one sealing element.

In a presently preferred embodiment of the present invention, an ice making apparatus is provided wherein the ice machine has a drain that has internal surfaces that come in contact at least with water during operation of the ice making and storage apparatus, and wherein the ice storage bin has a drain that has internal surfaces that come in contact at least with water during operation of the ice making and storage apparatus.

In a presently preferred embodiment of the present invention, an ice making apparatus is provided wherein the programmable control system controls flow of the cleaning solution so as to flood the internal surfaces of the ice machine, the internal surfaces of the ice transport conduit, and the internal surfaces of the drain of the ice machine with cleaning solution during the cleaning operation to thereby clean and disinfect the internal surfaces of the ice machine, the internal surfaces of the ice transport conduit, and the internal surfaces of the drain of the ice machine.

In a presently preferred embodiment of the present invention, an ice making apparatus is provided wherein the ice making and storage apparatus further comprises a cabinet housing at least the ice machine and the ice storage bin, wherein the cleaning container is in the form of a drawer supported for rectilinear motion by the cabinet between a first position within the cabinet and a second position, a user being able to access the cleaning container for filling with the cleaning solution at least when the cleaning container is in the second position, wherein the cleaning container outlet conduit has a first portion and a second portion, wherein the first portion of the cleaning container outlet conduit is fixed relative to the cleaning container, wherein the second portion of the cleaning container outlet conduit is fixed relative to the cabinet, wherein the first portion of the cleaning container outlet conduit is connected for fluid communication to the second portion of the cleaning container outlet conduit by a telescoping joint between the first portion of the cleaning container outlet conduit and the second portion of the cleaning container outlet conduit, and wherein the telescoping joint is sealed by at least one sealing element.

In a presently preferred embodiment of the present invention, an ice making apparatus is provided wherein the ice discharge outlet has internal surfaces that come in contact at least with ice during operation of the ice making and storage apparatus, wherein the ice discharge inlet has internal surfaces that come in contact at least with ice during operation of the ice making and storage apparatus, wherein the programmable control system controls flow of the cleaning solution so as to flood the internal surfaces of the ice discharge outlet and the internal surfaces of the ice discharge inlet with cleaning solution during the cleaning operation to thereby clean and disinfect the internal surfaces of the ice discharge outlet, the internal surfaces of the ice discharge inlet.

In a presently preferred embodiment of the present invention, an ice making apparatus is provided wherein said programmable control system includes the ice making and storage apparatus further comprising:

a user interface communicating with said computer system, said user interface comprising a means for initiating said cleaning operation by a user, and wherein said programmable control system includes means for indicating to a user the status of said cleaning operation while said programmable control system controls the ice making and storage apparatus, including at least one of the following:

means for indicating that the ice making apparatus has been drained to prompt the user to place a quantity of cleaning solution in said cleaning container;

means for indicating to a user that said cleaning container is charged with cleaning solution;

means for indicating to a user that said clean container is closed;

means for indicating to a user that the programmable control system is controlling flow of cleaning solution to various parts of the ice making apparatus to clean and sanitize the ice making apparatus; and means for indicating to a user that said cleaning operation is complete.

In a presently preferred embodiment of the present invention, an ice making apparatus is provided wherein the programmable control system includes a programmable computer system, the ice making and storage apparatus further comprising:

a user interface communicating with the computer system, the user interface comprising a clean switch that initiates the cleaning operation when pressed by a user, and a cleaning indicator light;

wherein the programmable control system turns on the light continuously while the programmable control system controls the ice making and storage apparatus to drain the ice making apparatus;

wherein the programmable control system controls the light to blink after the ice making apparatus is drained to prompt the user to place a quantity of cleaning solution in the cleaning container;

wherein the programmable control system turns on the light continuously when the cleaning container is charged with cleaning solution and closed;

wherein the programmable control system keeps the light on continuously while the programmable control system controls flow of cleaning solution to various parts of the ice making apparatus to clean and sanitize the ice making apparatus; and wherein the programmable control system turns off the light when the cleaning operation is complete.

In a presently preferred embodiment of the present invention, an ice making apparatus is provided wherein the ice making apparatus further comprises:

an ice storage bin; and an ice discharge inlet communicating with the ice storage bin and the ice machine, the ice discharge inlet allowing the ice made by the ice machine to be discharged into the ice storage bin;

wherein the ice making apparatus has an access opening for the ice storage bin, the ice making apparatus further comprises:

an ice scoop having a handle;

a sleeve for receiving the ice scoop; and a hook fixed to the sleeve, the hook being dimensioned and configured to engage a bottom edge of the opening for access to the ice storage bin such that, when the scoop is placed in the sleeve and the sleeve is hooked to the bottom edge of the opening for access to the ice storage bin, the handle of the ice scoop is prominently positioned within the opening for access to the ice storage bin to thereby prompt a user to employ the scoop for obtaining ice from the ice storage bin.

In a presently preferred embodiment of the present invention, an ice making apparatus is provided wherein the ice making apparatus further comprises:

an ice storage bin; and an ice discharge inlet communicating with the ice storage bin and the ice machine, the ice discharge inlet allowing the ice made by the ice machine to be discharged into the ice storage bin;

wherein the ice making and storage apparatus has a door for allowing access to the ice storage bin, the ice making and storage apparatus further comprising:

a door opening detector means communicating with the programmable control system, wherein the programmable control system records the number of times the door has been opened during a preselected period and the length of time the door remains open, and wherein the programmable control system controls the ice machine to make ice after the time during which the door has been open and exceeds a preprogrammed threshold or after the number of door opening during the preselected period exceeds a predetermined threshold.

In a presently preferred embodiment of the present invention, an ice making and storage apparatus is provided, the ice making and storage apparatus comprising:

an ice storage bin, wherein the ice making and storage apparatus has an access opening for the ice storage bin; and manual means for withdrawing ice from the ice storage bin.

In a presently preferred embodiment, the manual means for withdrawing ice from the storage bin include:

an ice scoop having a handle;

a sleeve for receiving the ice scoop; and a hook fixed to the sleeve, the hook being dimensioned and configured to engage a bottom edge of the opening for access to the ice storage bin such that, when the scoop is placed in the sleeve and the sleeve is hooked to the bottom edge of the opening for access to the ice storage bin, the handle of the ice scoop is prominently positioned within the opening for access to the ice storage bin to thereby prompt a user to employ the scoop for obtaining ice from the ice storage bin.

In a presently preferred embodiment of the present invention, an ice making and storage apparatus is provided, the ice making and storage apparatus comprising:

an ice machine for making ice, the ice machine having internal surfaces that come in contact with water and ice during normal operation of the ice making and storage apparatus;

an ice storage bin;

a programmable control system controlling operation of the ice making and storage apparatus;

a door for allowing access to the ice storage bin; and a door opening detector means communicating with the programmable control system, wherein the programmable control system controls the ice machine to make ice after the time during which the door has been open exceeds a preprogrammed threshold.

In a presently preferred embodiment of the present invention, a method of operating an ice making apparatus is provided, the process comprising the steps of:

initiating a cleaning operation in response to a user pressing the clean switch;

defrosting and draining the ice making apparatus;

keeping the cleaning indicator light on continuously during the step of defrosting and draining the ice making apparatus;

controlling the cleaning indicator light to blink after the ice making apparatus is drained to prompt the user to place a quantity of cleaning solution in the cleaning container;

controlling the cleaning indicator light to stay on continuously once the cleaning container is charged with cleaning solution and closed;

controlling flow of the cleaning solution to various parts of the ice making apparatus to clean and sanitize the ice making apparatus;

controlling the cleaning indicator light to remain on continuously during the step of controlling flow of the cleaning solution to various parts of the ice making apparatus to clean and sanitize the ice making apparatus; and turning off the cleaning indicator light when the cleaning operation is complete.

In a presently preferred embodiment of the present invention, an ice making apparatus is provided wherein the ice making apparatus comprises:

a full storage bin detector that generates a signal when the ice storage bin is full, wherein the ice machine stops making ice in response to the signal from the full storage bin detector.

These and other embodiments of the present invention will be apparent in view of the description below and the appended drawings and claims.

DETAILED DESCRIPTION OF THE PREFERRED EMBODIMENTS

Figure 1:
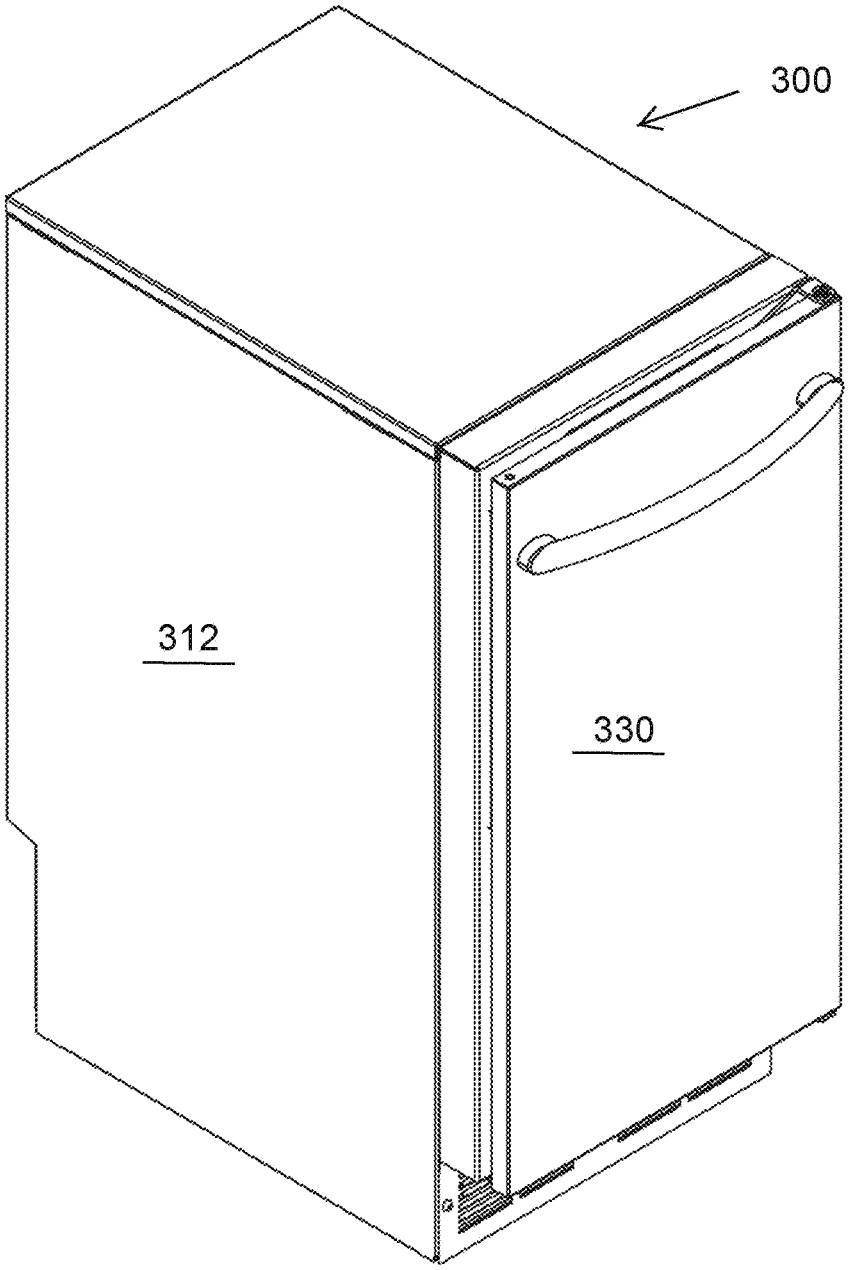
FIG. 1 is a perspective view of the ice making apparatus according to the invention as seen from the left front of the apparatus.
Figure 2:
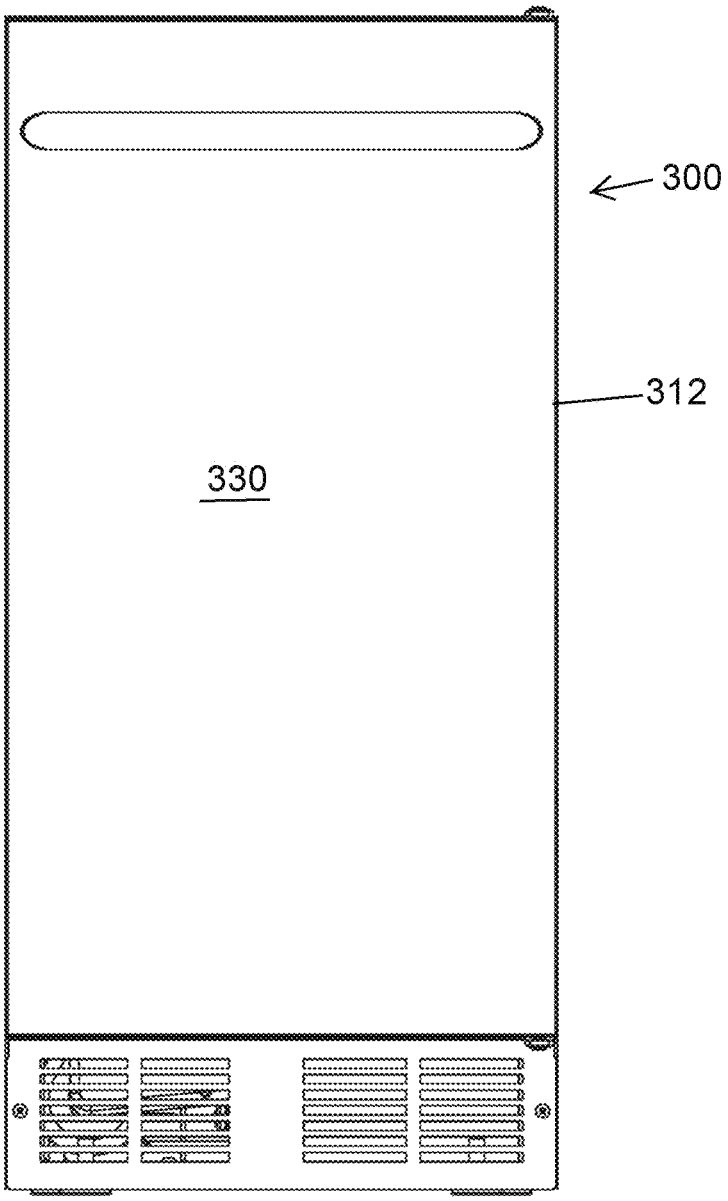
FIG. 2 is a front elevational view of the ice making apparatus of FIG. 1.

Referring to FIGS. 1-18, the ice making apparatus 300 of the present invention includes an enclosure 312 that includes a door 330 to provide an enclosed space while allowing user access to the interior of the enclosed space and thus to the ice storage bin 28 housed in the enclosure 312. The ice making apparatus 300 can, for example, employ an ice making machine 40, to supply ice to the ice storage bin 28. The ice making apparatus 300 has provision for executing cleaning procedures as will be described in more detail below.

Figure 3:
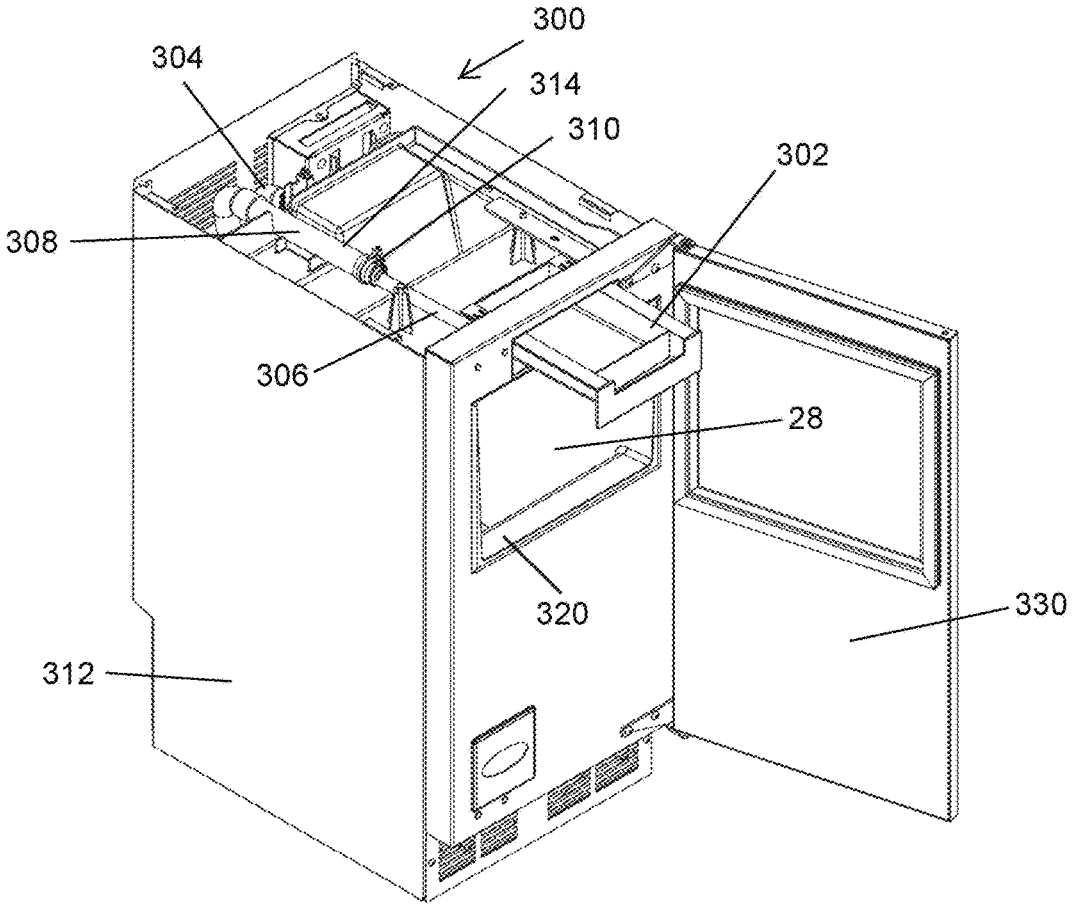
FIG. 3 is a perspective view of the ice making apparatus if FIG. 1 with the top body panel removed to reveal internal detail, showing the cleaning drawer in an open position.
Figure 4:
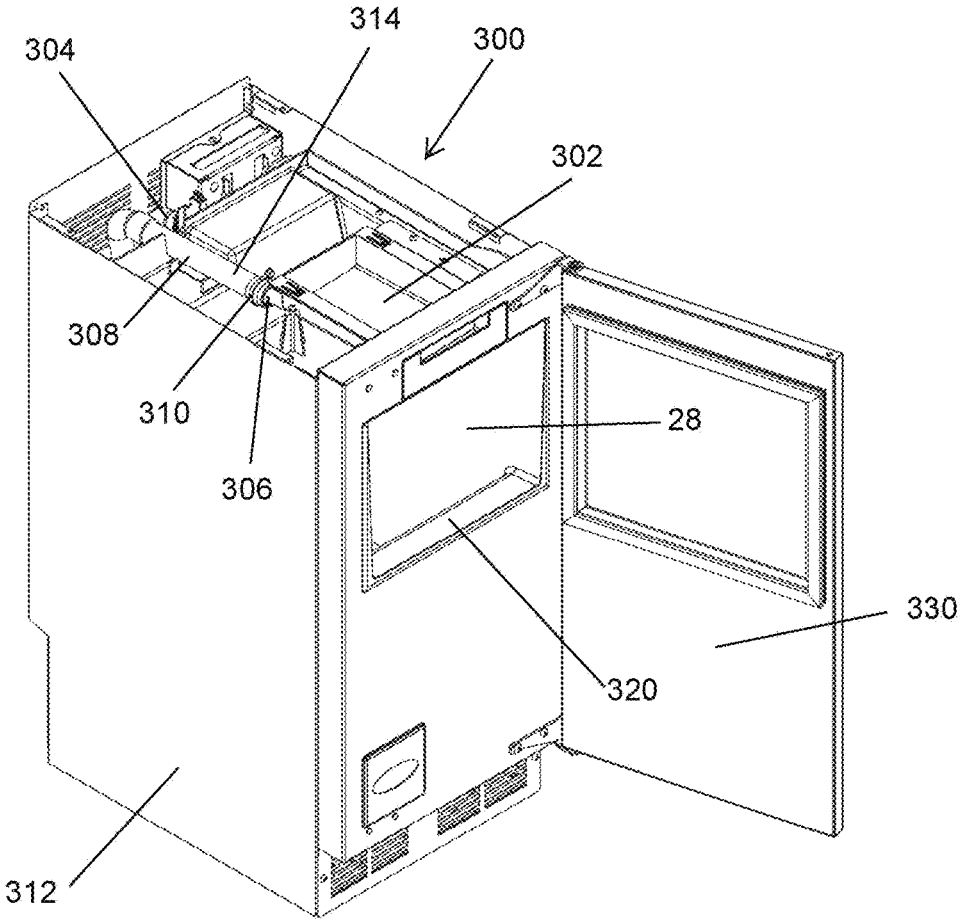
FIG. 4 is a perspective view of the ice making apparatus of FIG. 3 showing the cleaning drawer in a closed position.

As shown in the perspective views of FIGS. 3 and 4, the ice making apparatus 300 incorporates a cleaning drawer 302 located above an ice discharge inlet 304 to the ice storage bin 28 so that the entire ice making machine 40 (FIG. 5) can be flooded with cleaner and sanitizer. The machine's user or operator pours the cleaning and sanitizing solution into the drawer 302 and the solution floods all of the parts and pieces of the ice making machine 40 that are exposed to water and ice. The drawer 302 includes a tube 306 connected on the rear of the drawer 302 that moves with the drawer 302 as it is opened and closed. The tube 306 is connected for fluid communication with a stationary tube 308 by a telescoping joint 310 that is sealed against liquid leakage with a seal, as described below, which permits sliding movement of the tube 306 relative to the stationary tube 308 while sealing the telescoping joint 310 against liquid leakage.

The ice making machine 40 has internal surfaces that come in contact with water and ice during normal operation of the ice making and storage apparatus 300. A cleaning container, such as drawer 302, is housed within the ice making apparatus 300. The cleaning drawer 302 is provided for receiving a quantity cleaning solution. A cleaning drawer outlet tube 306 is in fluid communication with the cleaning drawer 302. The cleaning container outlet tube 306 allows the cleaning solution to be conducted from the cleaning drawer 302 to the ice machine 40 to clean and, preferably, sanitize and/or disinfect the internal surfaces of the ice machine 40.

The ice making apparatus 300 includes a programmable control system 400 (FIG. 17) controlling the conducting of the cleaning solution to the ice making machine 40, in accordance with a cleaning program during a cleaning operation as will be described below. The programmable control system 400 controls flow of the cleaning solution so as to flood the internal surfaces of the ice machine 40 with the cleaning solution during the cleaning operation to thereby clean and, preferably, sanitize and/or disinfect the internal surfaces of the ice machine 40.

Figure 5:
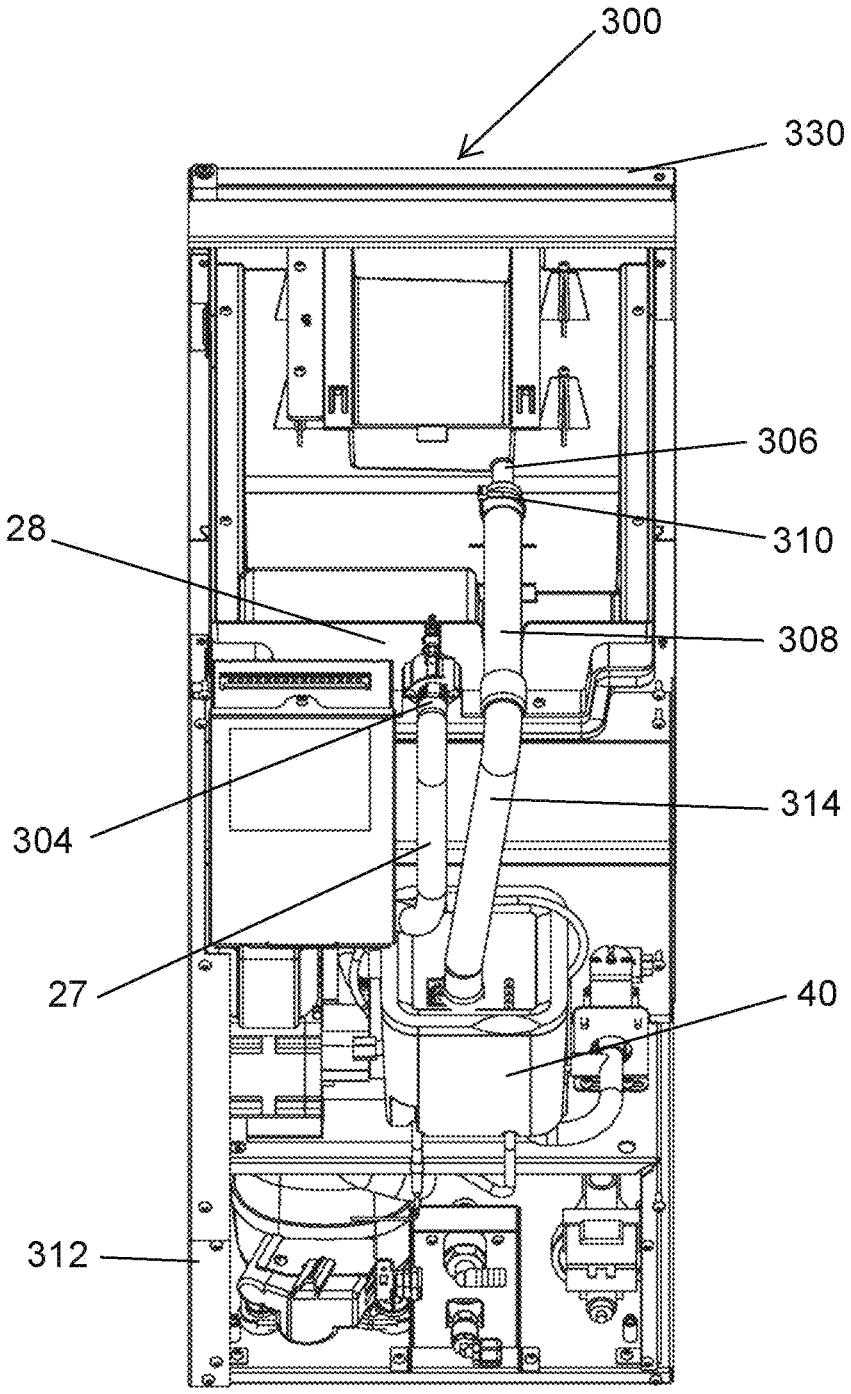
FIG. 5 is a rear perspective view of the ice making apparatus of FIG. 1 with the top and rear body panels removed to reveal internal detail.
Figure 6:
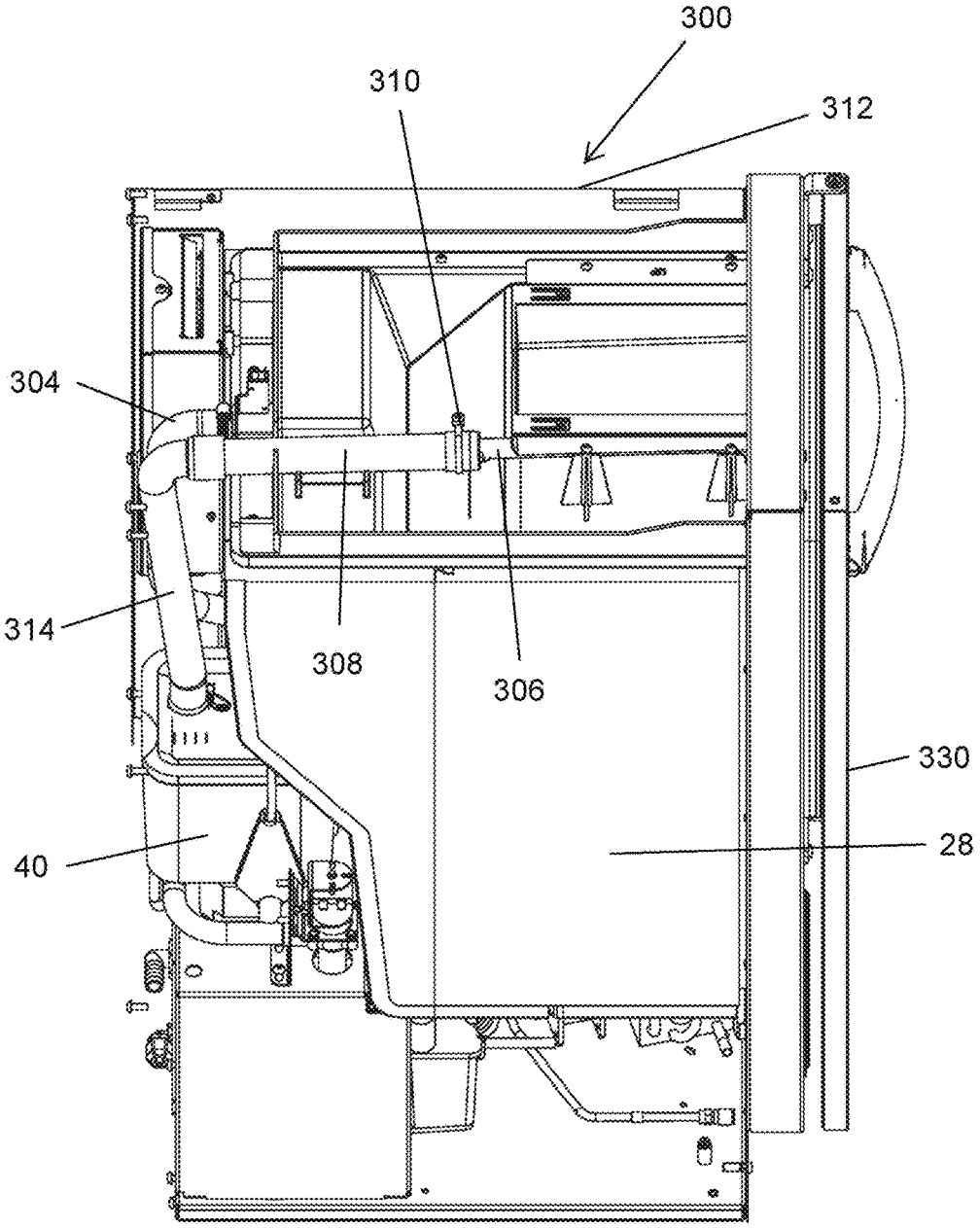
FIG. 6 is a left side elevational view of the ice making apparatus of FIG. 1 with the side body panel removed to reveal internal detail.
Figure 7:
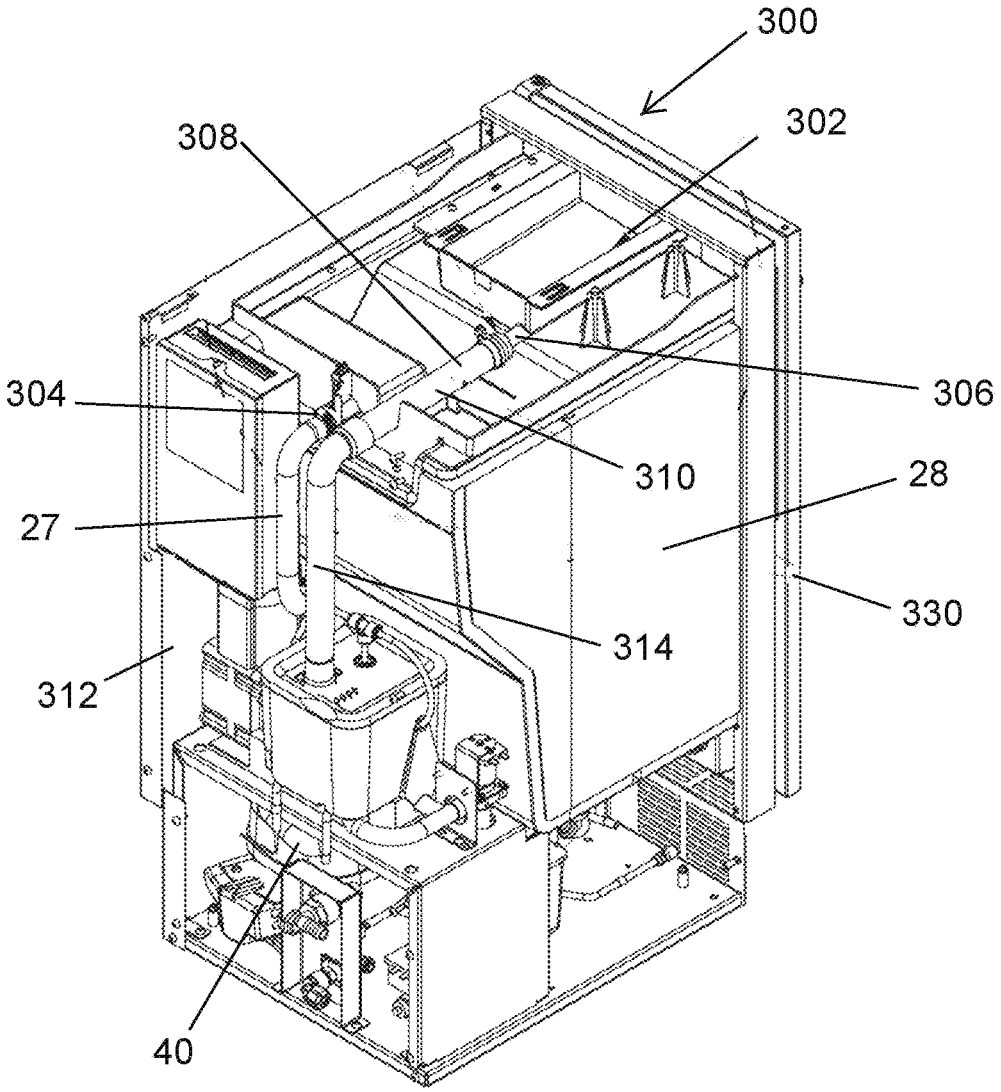
FIG. 7 is a perspective view of the of the ice making apparatus of FIG. 1 with the top, left side, and rear body panels removed to reveal internal detail, as seen from the left rear.
Figure 8:
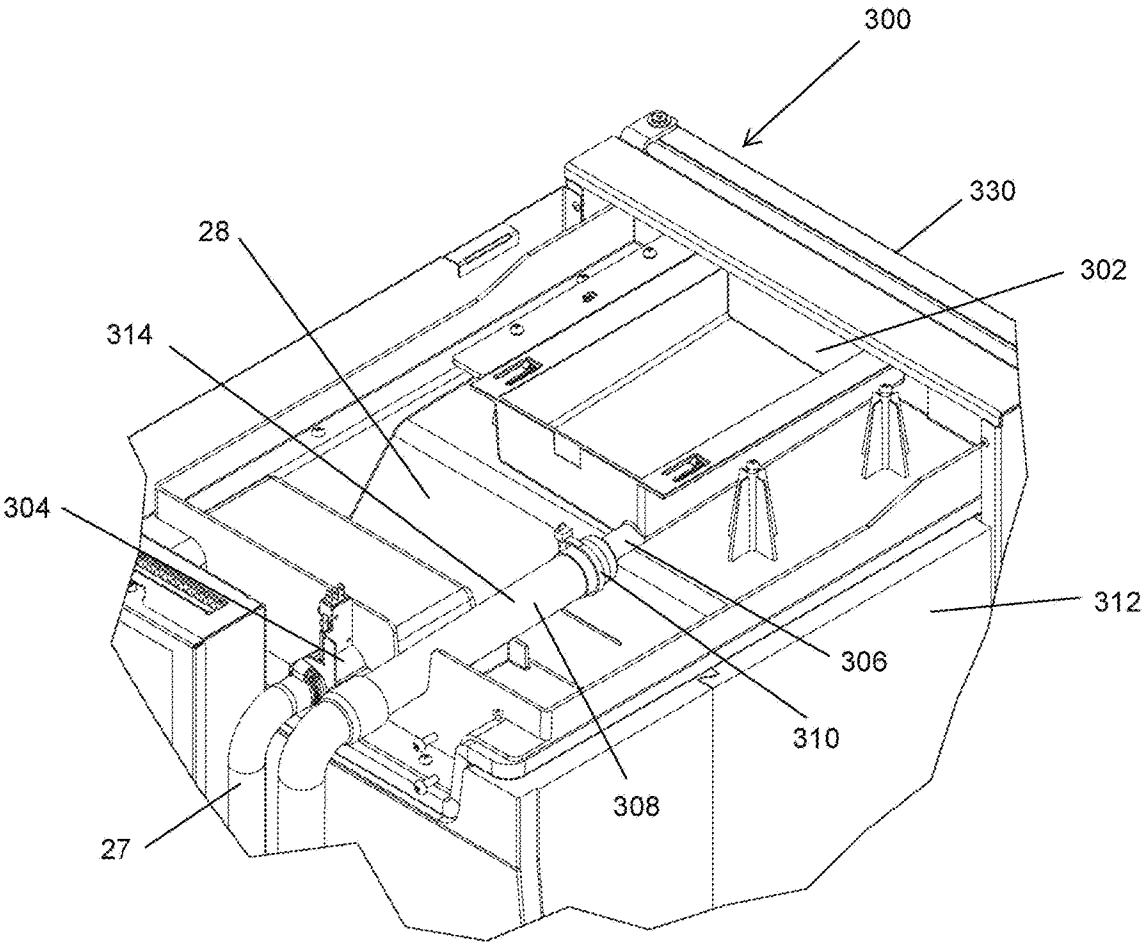
FIG. 8 is an exploded partial perspective view of the ice making apparatus of FIG. 1 with the top, left side, and rear body panels removed to reveal internal detail, as seen from the left rear.
Figure 9:
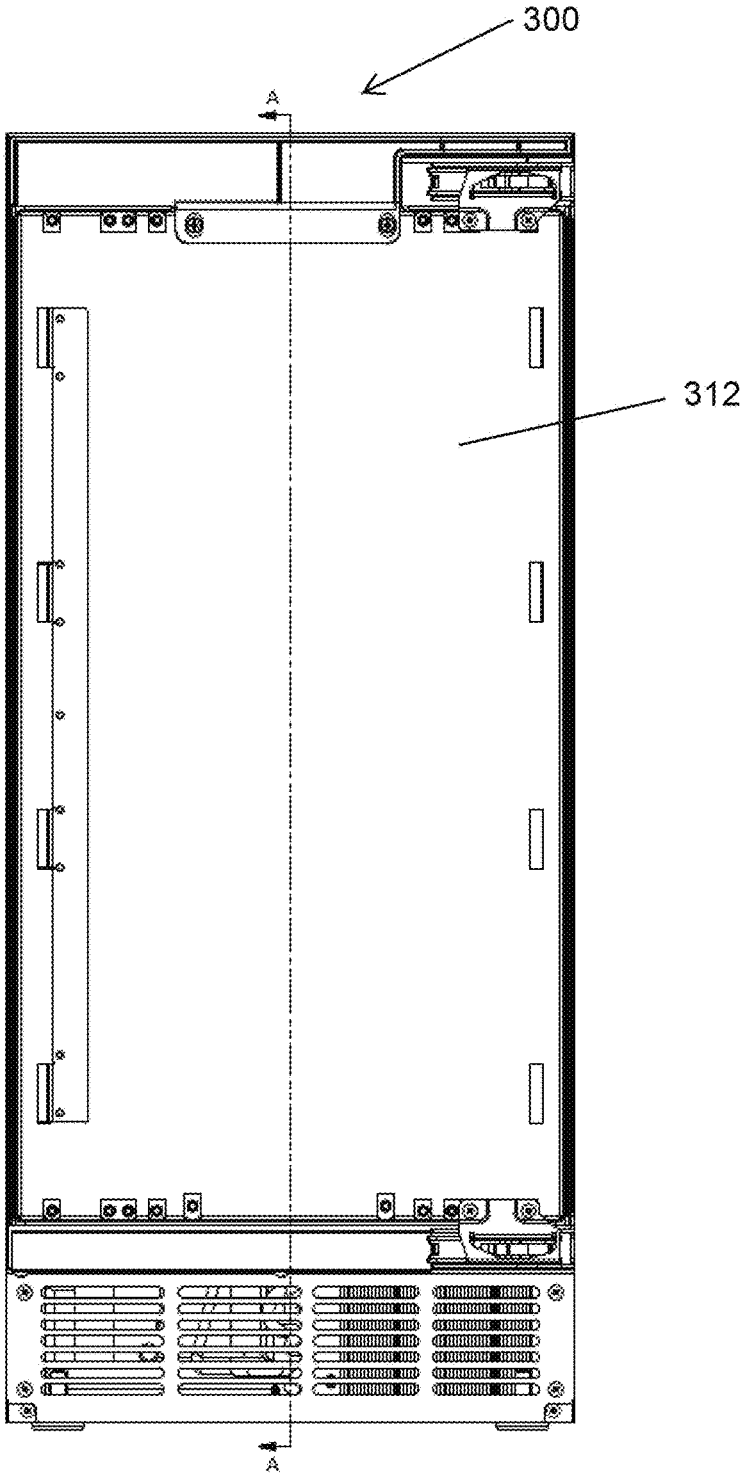
FIG. 9 is a rear elevational view of the ice making apparatus of FIG. 1.
Figure 10:
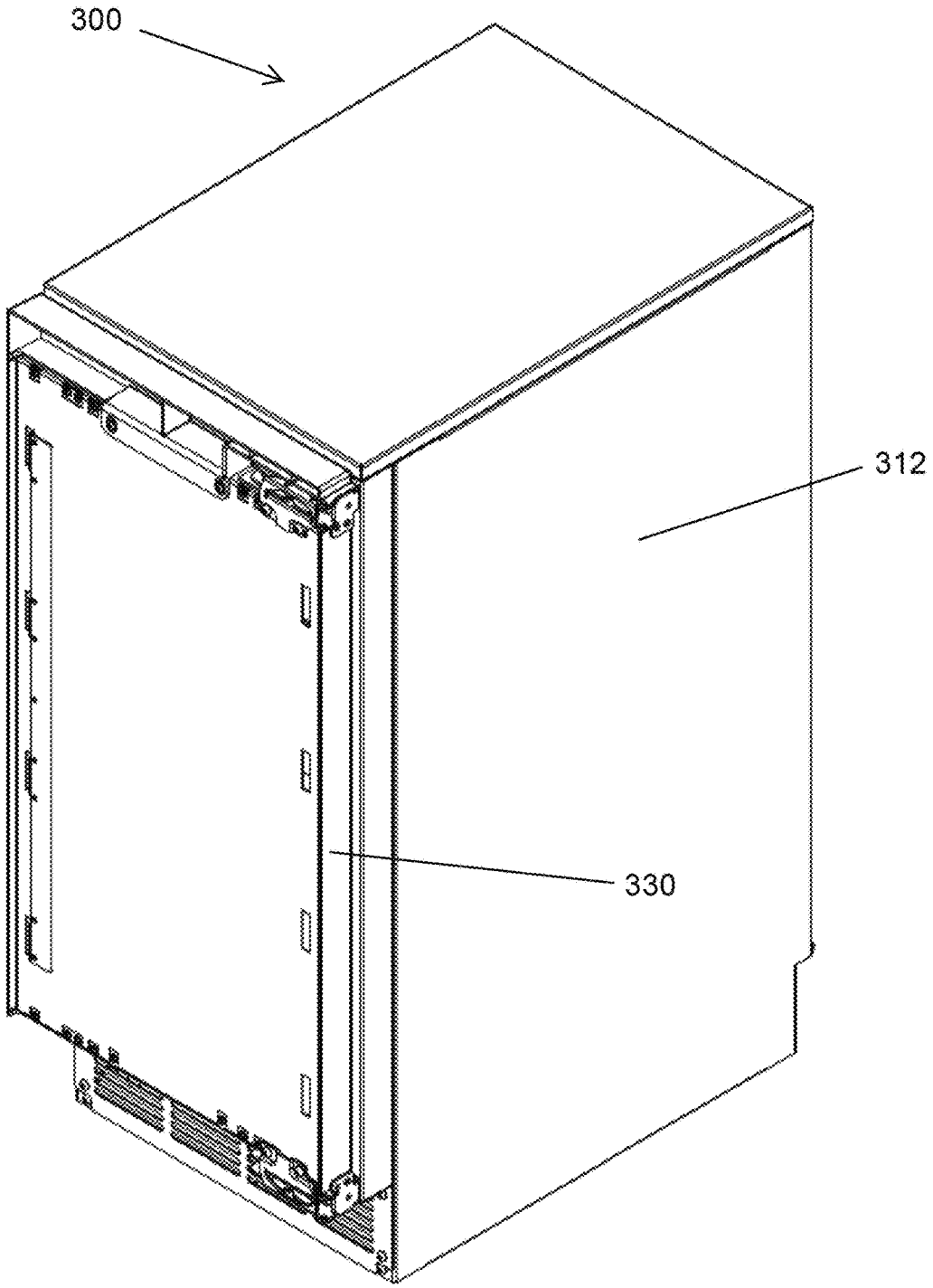
FIG. 10 is a perspective view of the ice making apparatus of FIG. 1 as seen from the left rear.
Figure 11:
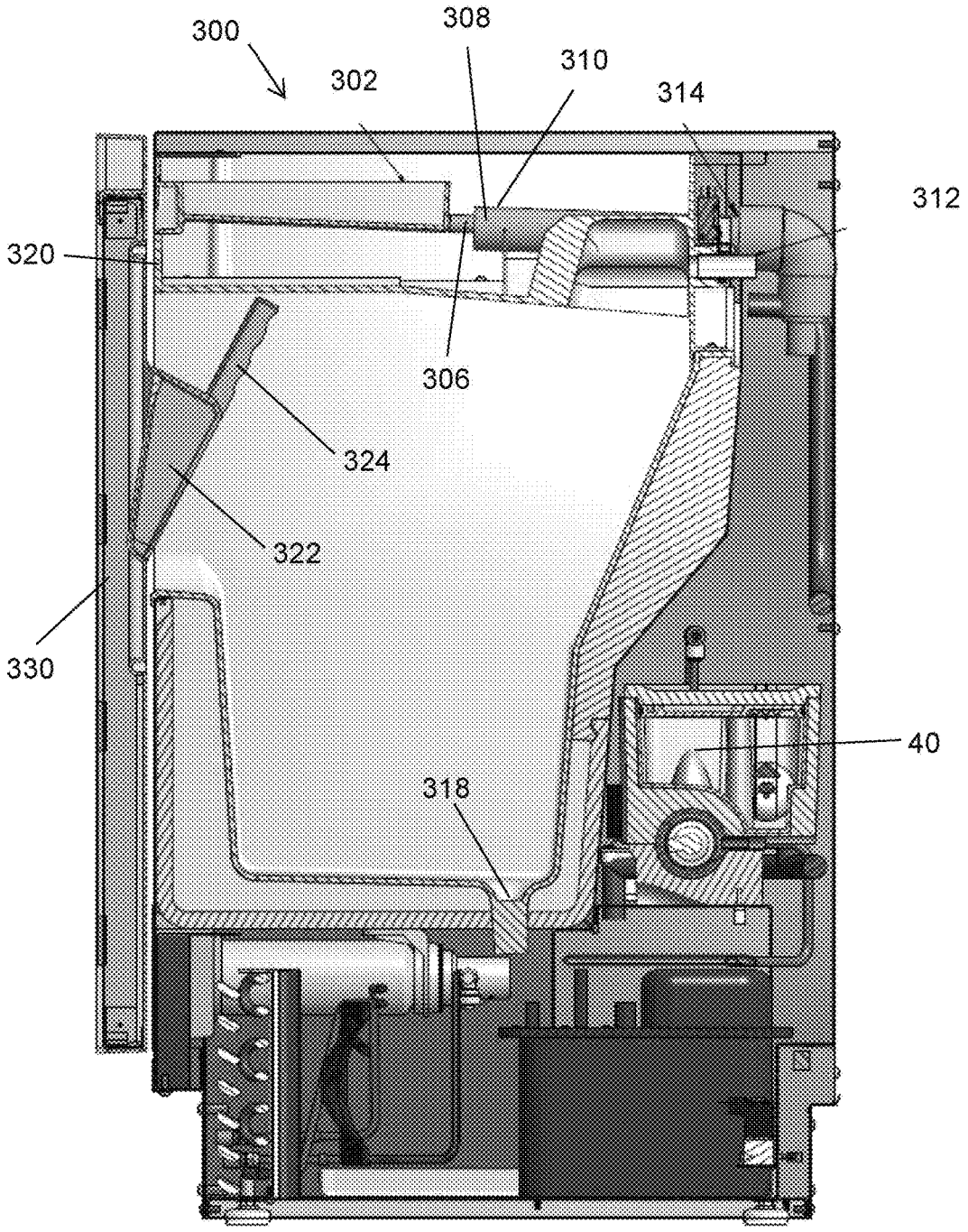
FIG. 11 is a cross sectional view of ice making apparatus according to the invention taken along the line A-A of FIG. 9.

As can be seen in the rear elevational view of FIG. 5, the ice making apparatus 300 comprises a cabinet 312 housing at least the ice machine 40. In the illustrated embodiment, the cabinet 312 houses at least the ice machine 40 and the ice storage bin 28. The cleaning container is in the form of a cleaning drawer 302 supported for rectilinear motion in the cabinet 312. The cleaning drawer 302 is movable between a first or closed position (FIG. 4) within the cabinet and a second or open position (FIG. 3). As shown in FIG. 3, the cleaning drawer 302 is at least in part outside the cabinet 312 when it is in the open position. A user is able to access the cleaning container, a cleaning drawer 302 in the illustrated example, for filling the container with the cleaning solution at least when the cleaning drawer 302 is in the second or open position. The cleaning container outlet conduit 314 has a first portion 306 and a second portion 308. The first portion 306 of the cleaning container outlet conduit 314 is fixed relative to the cleaning container 302. The second portion 308 of the cleaning container outlet conduit 314 is fixed relative to the cabinet 312. The first portion 306 of the cleaning container outlet conduit 314 is connected for fluid communication to the second portion 308 of the cleaning container outlet conduit 314 by a telescoping joint 310 between the first portion 306 of the cleaning container outlet conduit 314 and the second portion 308 of the cleaning container outlet conduit 314. The telescoping joint 310 is sealed by at least one sealing element such that the telescoping joint 310 is provided with a seal that permits relative sliding movement between the first portion 306 of the cleaning container outlet conduit 314 and the second portion 308 of cleaning container outlet conduit 314 while preventing liquid leakage through the telescoping joint 310.

Figure 14:
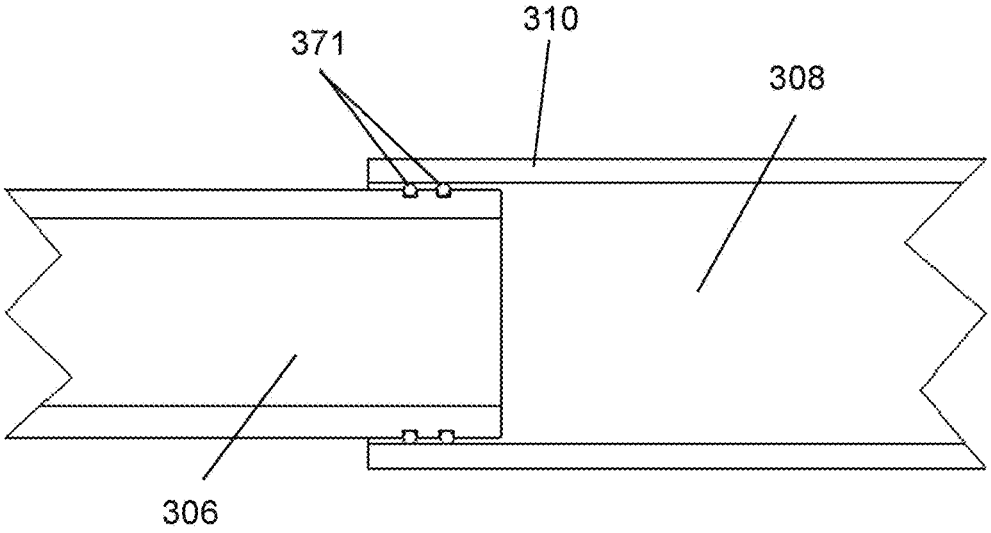
FIGS. 14-16 show various embodiments of the telescoping joint of the ice making apparatus according to the invention.
Figure 15:
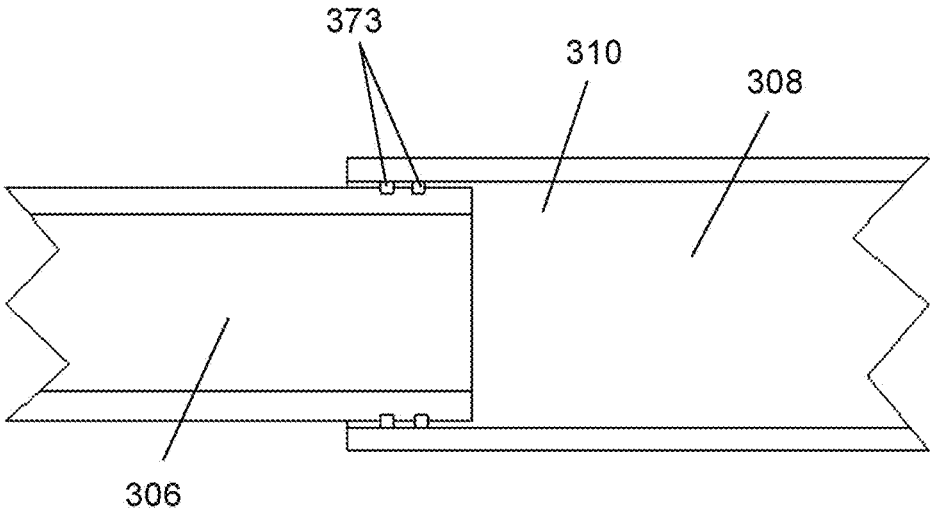
Figure 16:
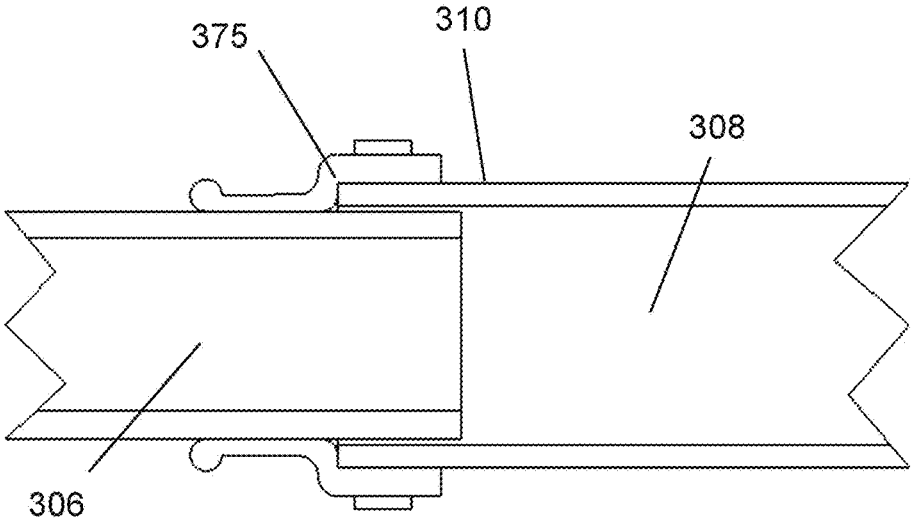

The at least one sealing element can be a rubber gasket, a rubber O-ring, a rubber boot, or the like. The seal for the telescoping joint 310 may include several sealing elements that are of the same kind or of a combination of various kinds. As shown in FIG. 14, a plurality of O-rings 371 (such as a pair) can be used to seal the telescoping joint 310. Alternatively, as depicted in FIG. 15, a plurality of elastomeric gaskets having a square cross section 373. In another alternative, such as shown in FIG. 16, an elastomeric boot 375 can be employed to seal the telescoping joint 310.

The ice making apparatus 300 includes an ice storage bin 28, and an ice discharge inlet 304 (best seen in FIG. 5) which communicates between the ice storage bin 28 and the ice making machine 40. In operation, the ice made by the ice making machine 40 is discharged through the ice discharge inlet 304 into the ice storage bin 28.

The ice making and storage apparatus 300 further comprises an ice transport conduit 27 communicating with the ice making machine 40 and an ice discharge inlet 304 to thereby allow the ice made by the ice machine 40 to be transported to the ice storage bin 28. The ice transport conduit 27 has internal surfaces that come in contact at least with ice during operation of the ice making apparatus 300.

The programmable control system 400 controls flow of the cleaning solution so as to flood the internal surfaces of the ice machine 40 and the internal surfaces of the ice transport conduit 27 with the cleaning solution during the cleaning operation to thereby clean and/or disinfect and/or sanitize the internal surfaces of the ice machine 40 and the internal surfaces of the ice transport conduit 27.

The ice making apparatus 300 is provided with a drain line that has internal surfaces that come in contact at least with water during operation of the ice making and storage apparatus 300. The ice storage bin 28 has a drain 318 (FIG. 11) that has internal surfaces that come in contact at least with water during operation of the ice making and storage apparatus 300.

The stationary tube communicates with the water reservoir of the ice machine 40. The programmable control system 400 controls the flow of the cleaning solution so as to flood the internal surfaces of the ice machine 40, the internal surfaces of the ice transport conduit 27, and the internal surfaces of the drain of the ice machine 40 with cleaning solution during the cleaning operation to thereby clean and/or disinfect and/or sanitize the internal surfaces of the ice machine 40, the internal surfaces of the ice transport conduit 27, and the internal surfaces of the drain of the ice machine 40.

The ice machine 40 has an ice discharge outlet (not shown) which has internal surfaces that come in contact at least with ice during operation of the ice making and storage apparatus 300. The ice discharge inlet 304 has internal surfaces that come in contact at least with ice during operation of the ice making and storage apparatus 300. The programmable control system 400 controls the flow of the cleaning solution so as to flood the internal surfaces of the ice discharge outlet and the internal surfaces of the ice discharge inlet 304 with cleaning solution during the cleaning operation to thereby clean and/or disinfect and/or sanitize the internal surfaces of the ice discharge outlet and the internal surfaces of the ice discharge inlet 304.

Figure 17:
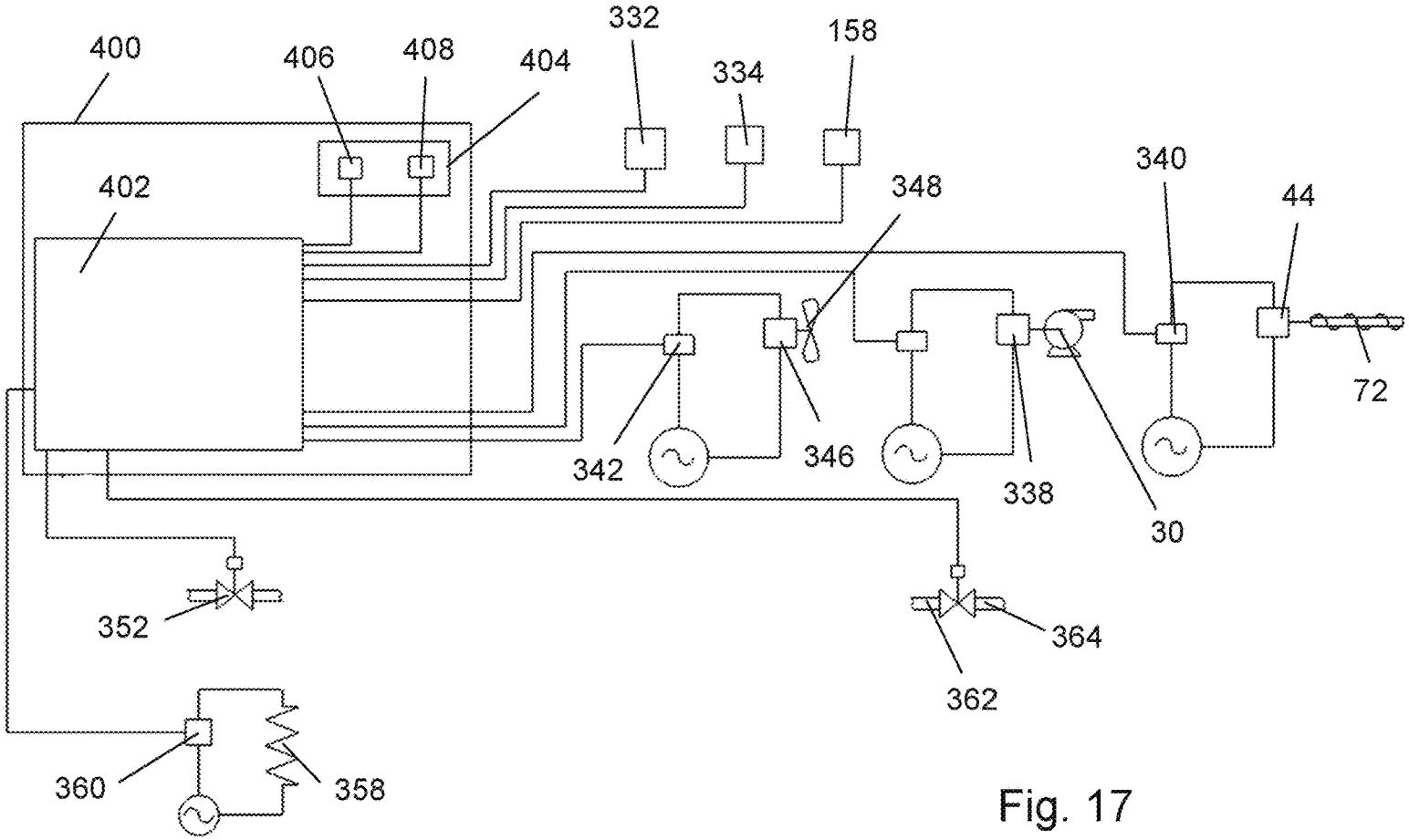
FIG. 17 is a schematic diagram of the control system of the ice making apparatus of FIG. 1.

The programmable control system 400, shown schematically in FIG. 17, includes a programmable computer system 402. The ice making and storage apparatus 300 includes a user interface 404 communicating with the computer system 402. The user interface can take a variety of forms, as is well known in the art. For example, the user interface may include a touch screen display for controlling operation of the ice making and storage apparatus 300, including operation of the cleaning system herein disclosed. The user interface may include a wireless or Bluetooth connection to a remote user control, such as a cell phone app, for remotely controlling operation of the ice making and storage apparatus 300, including the cleaning system herein disclosed.

In a presently preferred embodiment, the user interface 404 includes a clean switch 406 that initiates the cleaning operation when pressed by a user. The user interface 404 also includes a cleaning indicator, such as, for example, a cleaning indicator light 408. The programmable control system 400 can activate the cleaning indicator, such as by turning on light 408 continuously, to indicate to the user that the programmable control system 400 is controlling the ice making and storage apparatus 300 to drain the ice making apparatus 300. Similarly, the programmable control system 400 can by employed to use a cleaning indicator to prompt the user to place a quantity of cleaning solution in the cleaning container 302, such as by controlling a light to signal to the user, such as by blinking, after the ice making apparatus 300 is drained. The programmable control system 400 can be employed to signal to the user that the cleaning container has been adequately charged with cleaning solution and closed, such as for example, turning on the light 408 continuously. Further, the programmable control system 400 can signal to the user that the programmable control system 400 is controlling the flow of cleaning solution to various parts of the ice making apparatus 300 to clean and sanitize the ice making apparatus 300, such as by keeping the light 408 on continuously while the cleaning operation takes place. Similarly, the programmable control system 400 can be employed to signal to the user that the cleaning operation is complete, such as, for example, by turning off the light 408. While the signaling system described above is exemplary, other means of signally various stages of the cleaning process to the user can be provided in addition or in the alternative to that described. For example, signaling can take the form of visual or aural stimulate, such as text messages, specific tones representing the beginning or the completion of various stages of the cleaning process or the like.

Figure 12:
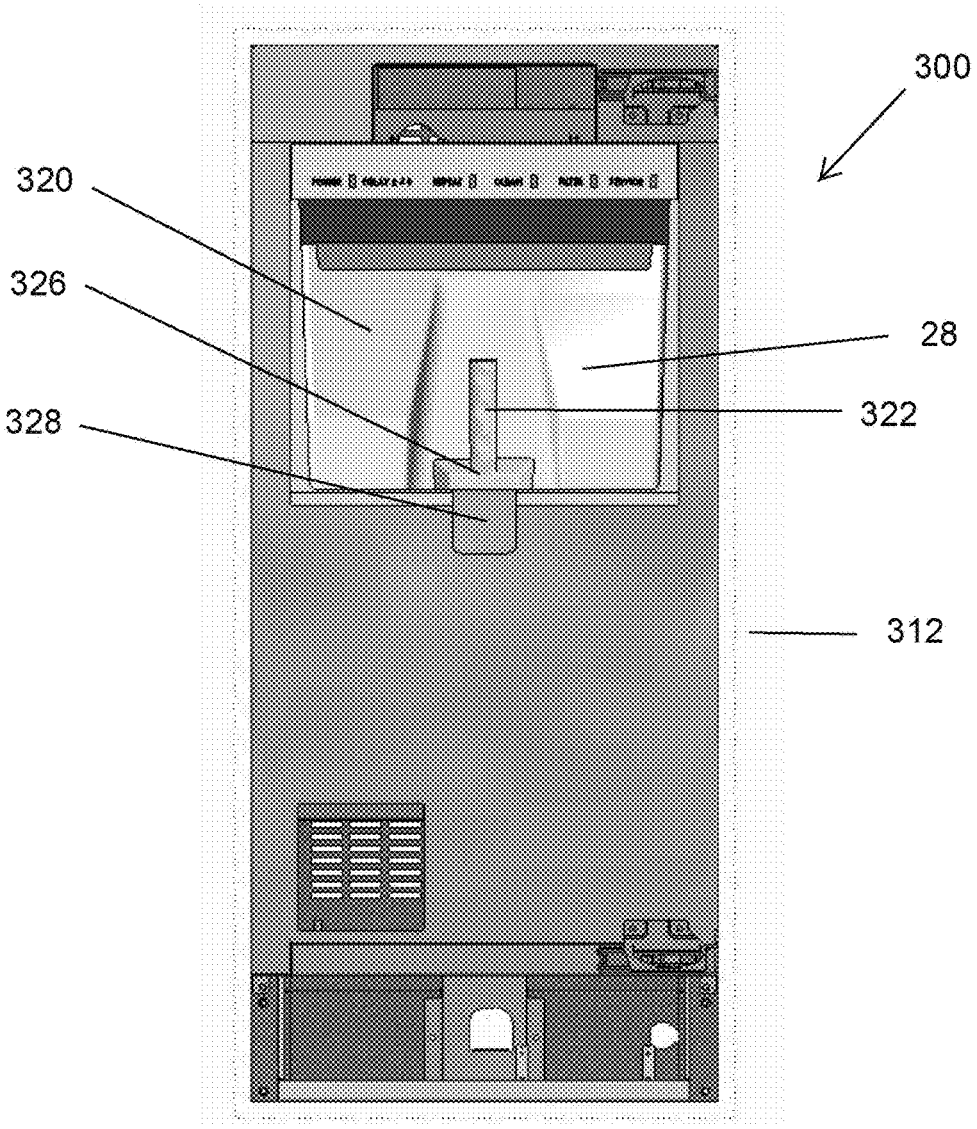
FIG. 12 is a front elevation view of the ice making apparatus of FIG. 1 shown with the door open to reveal interior detail.
Figure 13:
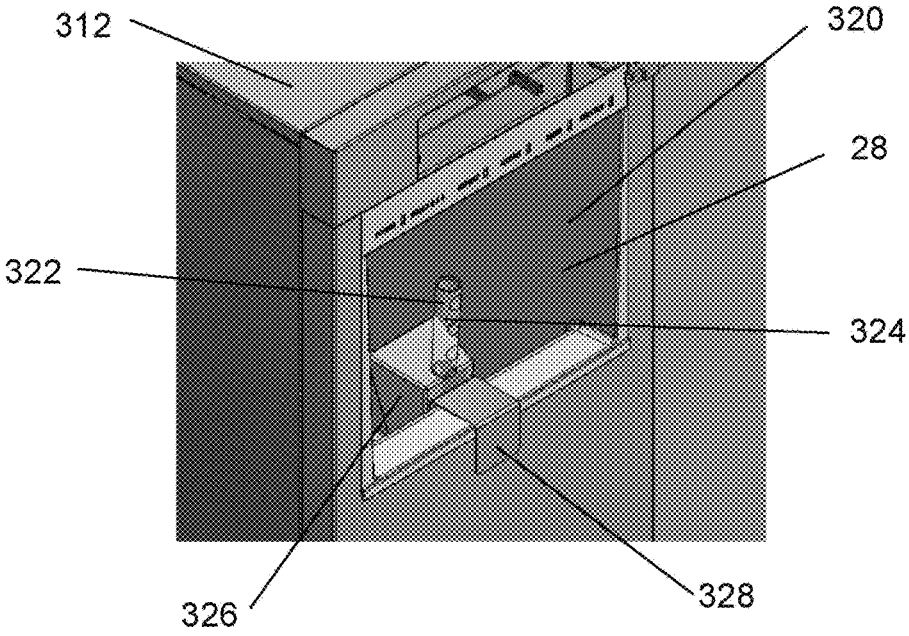
FIG. 13 is a fragmentary perspective view of the ice making apparatus of FIG. 1 shown with the door open and showing details of the ice bin opening and the ice scoop.

As shown in FIGS. 12 and 13, the ice making apparatus 300 has an access opening 320 for the ice storage bin 28. The ice making apparatus 300 can further include an ice scoop 322 having a handle 324. The ice making apparatus 300 can be provided with a sleeve 326 for receiving the ice scoop 322. The sleeve 326 has a hook 328 that is fixed to the sleeve 326. The hook 328 is dimensioned and configured to engage a bottom edge of the opening 320, which is provided for access to the ice storage bin 28. When the scoop 322 is placed in the sleeve 326 and the sleeve 326 is hooked to the bottom edge of the opening 320, the handle of the ice scoop 322 is prominently positioned within the opening 320 to thereby prompt a user to employ the scoop 322 for obtaining ice from the ice storage bin 28, in order to encourage the user to employ the provided scoop 322 to remove ice from the bin rather than to use cup, ice bucket, or the like, which might introduce foreign matter into the ice contained therein.

The ice making and storage apparatus 300 has a door 330 (FIGS. 1-4) for allowing access to the ice storage bin 28. The door 330 provides a closure for the opening 320. The ice making and storage apparatus 300 optionally includes a door opening detector means 332 (shown schematically in FIG. 17) communicating with the programmable control system 400 and more specifically with the computer system 402. Preferably, the door opening detector means 332 detects both the opening and the closing of the door 330. The door opening detector means 332 may be a pressure switch that is opened or closed when the door is opened or closed to generate a signal to the control system 400 indicative of the closing and opening of the door 330. The door opening detector means 332 may alternatively be an electro-optical or an electro-magnetic detector or any other detector suitable for the purpose of detecting the opening and closing of the door 330.

The programmable control system 400 optionally records the number of times the door 330 has been opened during a preselected period and the length of time the door remains open, and the programmable control system 400 controls the ice machine 40 to make ice after the time during which the door has been open exceeds a preprogrammed threshold or after the number of door openings during the preselected period exceeds a predetermined threshold.

Figure 18:
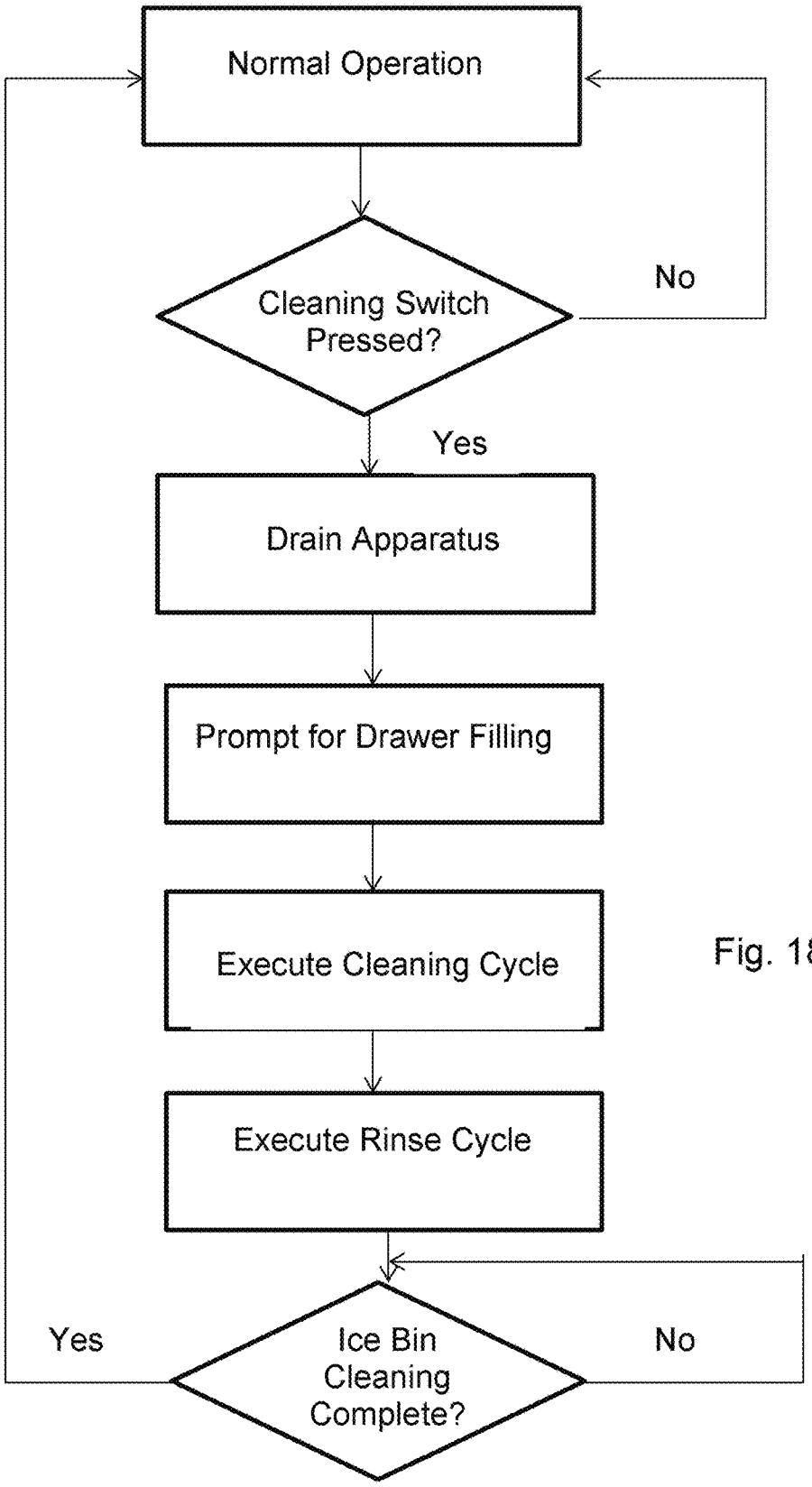
FIG. 18 is a flow chart of the cleaning method of the present invention.

Referring to FIGS. 17 and 18, the present invention also provides a method of operating an ice making apparatus that includes the steps as described below. A user initiates the cleaning operation, such as by responding to a user pressing a clean switch 406. The first step is defrosting and draining the ice making apparatus 300. Operation of the ice making apparatus during this step, that is the defrosting and draining the ice making apparatus, can optionally be indicated to the user, such as by keeping the cleaning indicator light 408 on continuously during the step. After the ice making apparatus 300 has been drained, the ice making apparatus can prompt the user to place a quantity of cleaning solution in the cleaning drawer 302, such as by controlling the cleaning indicator light 408 to cause the light 408 to blink when the ice making apparatus 300 has been drained. After the cleaning drawer has been charged with cleaning solution, and the cleaning drawer has been closed, the ice making apparatus 300 can execute the cleaning cycle, and the operation during this step can be communicated to the user, such as by controlling the cleaning indicator light 408 to stay on continuously once the cleaning container 302 is charged with cleaning solution and closed, and the cleaning cycle has thus begun.

For this purpose, an opening and closing detector 334 (FIG. 17) for detecting the opening and closing of the drawer 302 can optionally be provided as part of the ice making apparatus 300. The opening/closing detector 334 communicates with the programmable control system 400 and more specifically with the computer system 402. The drawer opening/closing detector 334 may be a pressure switch that is opened or closed when the drawer 302 is opened or closed to generate a signal to the control system 400 indicative of the closing and opening of the drawer 302. The drawer opening/closing detector 334 may alternatively be a electro-optical or an electro-magnetic detector or any other detector suitable for the purpose of detecting the opening and closing of the drawer 302.

The next step is controlling flow of the cleaning solution to various parts of the ice making apparatus to clean and sanitize the ice making apparatus 300. This step of the process can be indicated to the user by controlling the cleaning indicator light 408 to remain on continuously during the step of controlling flow of the cleaning solution to various parts of the ice making apparatus 300 to clean and sanitize the ice making apparatus 300. When the cleaning operation is complete, the completion can be indicated to the user, such as by turning off the cleaning indicator light 408.

Additional steps may include making ice for a predetermined period of time after completion of treating the apparatus 300 with the cleaning solution, and manually removing this initial batch of ice before the ice subsequently produced by the apparatus 300 is used for any of the various uses to which ice is normally put, such as for human consumption or in food or beverage service.

The ice making apparatus 300 optionally includes a full storage bin detector (not shown) that generates a signal when the ice storage bin 28 is full. The control system 400 can control the ice machine 40 such that the ice machine stops making ice in response to the signal from the full storage bin detector indicating that the ice storage bin 28 is full.

Optionally, when the bin 28 is full the full storage bin detector signals the computer system 402 that the bin 28 is full. The computer system 402 shuts down the ice making operation of the ice machine 40 by turning off the power to the ice making machine 40, including, for example, an auger motor 44, a condenser fan motor 346, and a compressor motor 338 via the switches 340, 342, and 344, respectively, such as shown in FIG. 17.

The ice making operation of the ice machine 40 can be resumed based on the signal from the door opening detector 332. The signal from the detector 332 is optionally monitored by the control system 400 for a predetermined period of time after the door 330 is opened for the first time after the ice making operation is shut down. The programmable control system 400 optionally records the number of times the door 330 has been opened during the predetermined period of time and/or the length of time the door 330 remains open each time it is opened during the predetermined period of time. The programmable control system 400 optionally controls the ice machine 40 to make ice after the total time during which the door 330 has been open, during the predetermined period of time, exceeds a preprogrammed threshold or after the number of door openings during the predetermined period of time exceeds a predetermined or preprogrammed threshold. The control system program may employ either of these thresholds by itself, or the control program may use both thresholds and resume ice making operation whenever any one of the thresholds is met or exceeded. The computer system 402 resumes the ice making operation of the ice machine 40 by turning on the power to the auger motor 44, the condenser fan motor 346, and the compressor motor 338 via the switches 340, 342, and 344, respectively.

Referring to FIG. 17, a schematic diagram of the control system of the present invention can be seen. The compressor 30, the auger 72, and the condenser fan 348 are powered by motors 338, 44, and 346, respectively. The control system 400 causes the motors 338, 44, and 346, and consequently the compressor 30, the auger 72, and the condenser fan 348, to be energized and working in order to make ice inside the evaporator. The control system 400 includes a microcomputer or computer system 402. The control system 400 energizes the motor 338 of the compressor 30, the auger motor 44, and the motor 346 of the condenser fan 348 based on the control schemes described above.

The computer system 402, and consequently the control system 400, communicates with the switches 340, 342, and 344, which may be of the reed switch type, relay, solenoid actuated type, or any other suitable type that can be electronically controlled to turn on or off; the switch 406; the light 408; and the solenoid valve 352, which opens and closes the ice machine evaporator/water reservoir drain. The computer system 402, and consequently the control system 400, communicates with the door opening detector 332, the shuttle or full ice bin detector or its alternatives mentioned above, and the drawer open/close detector 334. The ice making system 300, preferably, also includes a defrost heater 358 that is in thermal contact with the evaporator and a defrost heater switch 360 that is in communication with and controlled by the computer system 402.

During the defrost phase of the cleaning cycle, the control system 400 turns on the power to the defrost heater 358 to speed melting of ice and draining of the ice making apparatus 300. The defrost heater 358 is turned off before the light 408 is made to blink to prompt the user to fill the drawer 302 with cleaning solution. The auger motor 44 is operated to rotate the auger 72 to aid in the cleaning action of the cleaning solution. The valves 352 and 354 are kept closed during this step, which is referred to as the cleaning step. Because the drawer 302 is located above the ice discharge inlet 304, the cleaning solution will overflow into the ice bin 28' where it collects. After a predetermined time period valve 352 is opened to allow spent cleaning solution to be drained. Preferably, the cleaning step is repeated at least two more times for a total of three cleaning cycles.

After the last cleaning cycle and the draining of the spent cleaning solution, the valve 352 is closed. The computer system 402 is also in communication with and controls solenoid valve 362 provided in the water line 364 connected to the inlet of the water reservoir. After the cleaning steps or cycles, the valve 362 is opened to allow water under line pressure to flood the apparatus 300 to rinse the apparatus 300 and force any residual spent cleaning solution out of the ice machine 40 and into the ice storage bin 28. At the conclusion of the rinsing step, the valve 362 is closed and the valve 354 is opened by the computer system 402 to allow the rinse water collected in the ice storage bin 28 to be drained out of the apparatus 300. The ice storage bin 28 can then be manually cleaned as previously described.

As an alternative, the light 408 may be made to blink at the conclusion of the cleaning cycles to prompt the user or operator to fill the drawer 302 with clean rinse water. The rinse cycle or cycles would then be conducted in the same way as one or more of the cleaning cycles with rinse water replacing the cleaning solution.

Also, if warm or hot cleaning solution is used, there may be no need for a defrost heater. In such a case, any remaining ice in the ice machine will be melted and drained from the apparatus 300 during one or more of the cleaning cycles.

This invention is not limited to the illustrative embodiments described above and encompasses any and all embodiments within the scope of the appended claims and their equivalents.

REFERENCES

1. Scotsman Ice Systems, "Installation and User's Manual for Residential Nugget Ice Machine, Model SCN60," May 2011.
2. "Manitowoc SM Model Ice Machines, Installation, Use & Care Manual," Part Number 040001361 05/10, ©2010.
3. Hoshizaki America, Inc., "Self-Contained Cubelet, Models C-101BAH, C-101BAHDS, C-101BAHAD, C-101BAHADDS, Instruction Manual," Jul. 25, 2013.

The invention claimed is:

1. An ice making and storage apparatus comprising:

an ice machine for making ice, said ice machine having internal surfaces that come in contact with water and ice during normal operation of the ice making and storage apparatus;

a cleaning container housed within the ice making and storage apparatus, said cleaning container being provided for receiving a quantity of cleaning solution;

a cleaning container outlet conduit communicating with said cleaning container, said cleaning container outlet conduit allowing the cleaning solution to be conducted from said cleaning container to said ice machine to clean and disinfect the internal surfaces of said ice machine;

a programmable control system controlling conducting of the cleaning solution to said ice machine in accordance with a cleaning program during a cleaning operation;

wherein said programmable control system controls flow of the cleaning solution so as to flood said internal surfaces of said ice machine with the cleaning solution during said cleaning operation to thereby clean and disinfect said internal surfaces of said ice machine;

and said ice making apparatus further comprises a cabinet housing at least said ice machine, wherein said cleaning container is in the form of a drawer supported by said cabinet between a first position within said cabinet and a second position, a user being able to access said cleaning container for filling with the cleaning solution at least when said cleaning container is in said second position;

wherein said cleaning container outlet conduit has a first portion and a second portion, wherein said first portion of said cleaning container outlet conduit is fixed relative to said cleaning container, wherein said second portion of said cleaning container outlet conduit is fixed relative to said cabinet, wherein said first portion of said cleaning container outlet conduit is connected for fluid communication to said second portion of said cleaning container outlet conduit by a telescoping joint between said first portion of said cleaning container outlet conduit and said second portion of said cleaning container outlet conduit, and wherein said telescoping joint is sealed by at least one sealing element.

2. The ice making and storage apparatus of claim 1 wherein the drawer is supported for rectilinear motion in the cabinet.

3. The ice making and storage apparatus according to claim 1, wherein said at least one sealing element is selected from a group consisting of a rubber gasket, a rubber O-ring, and a rubber boot.

4. The ice making and storage apparatus according to claim 1, wherein the ice making apparatus further comprises:

an ice storage bin; and an ice discharge inlet communicating with said ice storage bin and said ice machine, said ice discharge inlet allowing the ice made by said ice machine to be discharged into said ice storage bin;

wherein said ice machine has an ice discharge outlet, the ice making and storage apparatus further comprising an ice transport conduit communicating with said ice discharge outlet and said ice discharge inlet to thereby allow the ice made by said ice machine to be transported to said ice storage bin, and wherein said ice transport conduit having internal surfaces that come in contact at least with ice during operation of the ice making apparatus.

5. The ice making and storage apparatus according to claim 4, wherein said programmable control system controls flow of the cleaning solution so as to flood said internal surfaces of said ice transport conduit with the cleaning solution during said cleaning operation to thereby clean and disinfect said internal surfaces of said ice transport conduit.

6. The ice making and storage apparatus according to claim 4, wherein said ice machine has a drain that has internal surfaces that come in contact at least with water during operation of the ice making and storage apparatus, and wherein said ice storage bin has a drain that has internal surfaces that come in contact at least with water during operation of the ice making and storage apparatus.

7. The ice making and storage apparatus according to claim 6, wherein said programmable control system controls flow of the cleaning solution so as to flood said internal surfaces of said drain of said ice machine with cleaning solution during said cleaning operation to thereby clean and disinfect said internal surfaces of said drain of said ice machine.

8. The ice making and storage apparatus according to claim 1, wherein said programmable control system includes the ice making and storage apparatus further comprising:

a user interface communicating with a computer system, said user interface comprising a means for initiating said cleaning operation by the user, and wherein said programmable control system includes means for indicating to the user a status of said cleaning operation while said programmable control system controls the ice making and storage apparatus to drain the ice making and storage apparatus, the means for indicating to the user including at least one of the following:

the ice making apparatus has been drained to prompt the user to place the quantity of cleaning solution in said cleaning container, that said cleaning container is charged with cleaning solution and closed, that the programmable control system is controlling flow of cleaning solution to various parts of the ice making apparatus to clean and sanitize the ice making apparatus, and that said cleaning operation is complete.

9. The ice making and storage apparatus according to claim 1, wherein the ice making apparatus further comprises:

an ice storage bin; and an ice discharge inlet communicating with said ice storage bin and said ice machine, said ice discharge inlet allowing the ice made by said ice machine to be discharged into said ice storage bin;

wherein the ice making apparatus has an access opening for said ice storage bin, the ice making apparatus further comprises manual means for withdrawing ice from the bin.

10. The ice making and storage apparatus according to claim 9, wherein the manual means for withdrawing ice from the bin comprises:

an ice scoop having a handle;

a sleeve for receiving said ice scoop; and a hook fixed to said sleeve, said hook being dimensioned and configured to engage a bottom edge of said opening for access to said ice storage bin such that, when said scoop is placed in said sleeve and the sleeve is hooked to the bottom edge of said opening for access to said ice storage bin, said handle of said ice scoop is prominently positioned within said opening for access to said ice storage bin to thereby prompt the user to employ said scoop for obtaining ice from said ice storage bin.

11. The ice making and storage apparatus according to claim 1 comprising:

an ice storage bin, wherein the ice making and storage apparatus has an access opening for said ice storage bin;

an ice scoop having a handle;

a sleeve for receiving said ice scoop; and a hook fixed to said sleeve, said hook being dimensioned and configured to engage a bottom edge of said opening for access to said ice storage bin such that, when said scoop is placed in said sleeve and the sleeve is hooked to the bottom edge of said opening for access to said ice storage bin, said handle of said ice scoop is prominently positioned within said opening for access to said ice storage bin to thereby prompt the user to employ said scoop for obtaining ice from said ice storage bin.

12. The ice making and storage apparatus according to claim 1 comprising: an ice storage bin; a door for allowing access to said ice storage bin; and a door opening detector means communicating with said programmable control system, wherein said programmable control system controls said ice machine to make ice after a time during which said door has been opened exceeds a preprogrammed threshold.

13. An ice making and storage apparatus comprising:

an ice machine for making ice, said ice machine having internal surfaces that come in contact with water and ice during normal operation of the ice making and storage apparatus;

a cleaning container housed within the ice making and storage apparatus, said cleaning container being provided for receiving a quantity of cleaning solution;

a cleaning container outlet conduit communicating with said cleaning container, said cleaning container outlet conduit allowing the cleaning solution to be conducted from said cleaning container to said ice machine to clean and disinfect the internal surfaces of said ice machine;

a programmable control system controlling conducting of the cleaning solution to said ice machine in accordance with a cleaning program during a cleaning operation;

wherein said programmable control system controls flow of the cleaning solution so as to flood said internal surfaces of said ice machine with the cleaning solution during said cleaning operation to thereby clean and disinfect said internal surfaces of said ice machine; and further comprises a cabinet housing at least said ice machine, wherein said cleaning container is in the form of a drawer supported by said cabinet between a first position within said cabinet and a second position, a user being able to access said cleaning container for filling with the cleaning solution at least when said cleaning container is in said second position;

wherein the ice making apparatus further comprises:

an ice storage bin; and an ice discharge inlet communicating with said ice storage bin and said ice machine, said ice discharge inlet allowing the ice made by said ice machine to be discharged into said ice storage bin;

wherein the ice making and storage apparatus has a door for allowing access to said ice storage bin, the ice making and storage apparatus further comprising:

a door opening detector means communicating with said programmable control system, wherein said programmable control system records a number of times the door has been opened during a preselected period and a length of time the door remains open, and wherein said programmable control system controls said ice machine to make ice after the time during which said door has been open exceeds a preprogrammed threshold or after the number of door openings during the preselected period exceeds a predetermined threshold.

14. A method of operating an ice making and storage apparatus, the method comprising the steps of:

initiating a cleaning operation in response to a user pressing a clean switch;

defrosting and draining the ice making and storage apparatus;

keeping a cleaning indicator light on continuously during said step of defrosting and draining the ice making and storage apparatus;

controlling said cleaning indicator light to blink after the ice making and storage apparatus is drained to prompt the user to place a quantity of cleaning solution in a cleaning container;

controlling said cleaning indicator light to stay on continuously once said cleaning container is charged with cleaning solution and closed;

controlling flow of the cleaning solution to various parts of the ice making apparatus to clean and sanitize the ice making and storage apparatus;

controlling said cleaning indicator light to remain on continuously during said step of controlling flow of the cleaning solution to various parts of the ice making and storage apparatus to clean and sanitize the ice making and storage apparatus; and turning off said cleaning indicator light when said cleaning operation is complete.

* * * * *